United States Patent [19]

Sasaki

[11] Patent Number: 4,498,074

[45] Date of Patent: Feb. 5, 1985

[54] SELECTIVELY TESTABLE FIRE DETECTOR

[75] Inventor: Isao Sasaki, Tokyo, Japan

[73] Assignee: Nittan Company, Limited, Tokyo, Japan

[21] Appl. No.: 351,916

[22] Filed: Feb. 24, 1982

[30] Foreign Application Priority Data

Feb. 25, 1981 [JP] Japan ..... 56-25495

[51] Int. Cl.[3] ..... G08B 29/00

[52] U.S. Cl. ..... 340/514; 340/512; 340/513

[58] Field of Search ..... 340/514, 500, 501, 515, 340/516, 537, 577–579, 588, 589, 628–630, 635, 512, 513; 169/60, 61, 23; 324/158 F

[56] References Cited

U.S. PATENT DOCUMENTS 3,657,713 4/1972 Sasaki et al. ..... 340/514

3,848,241 11/1974 LeNay et al. ..... 340/514

4,032,909 6/1977 Boyce ..... 340/514

*Primary Examiner*—Donnie L. Crosland

*Attorney, Agent, or Firm*—Abelman, Frayne, Rezac & Schwab

[57] ABSTRACT

A selectively testable fire detector comprises a fire detecting circuit supplied with a first voltage and which detects smoke and/or temperature, a self-holding circuit which is actuated by the output signal of the fire detecting circuit, a counter which counts pulses superimposed on the first voltage and outputs a signal when the counted number reaches a predetermined number assigned thereto, a latch circuit which latches the output signal of the counter and transmits to the fire detecting circuit a signal which actuates the fire detecting circuit, and a reset signal generating circuit which resets the counter and latch circuits by a second voltage which is higher than the first voltage.

6 Claims, 1 Drawing Figure

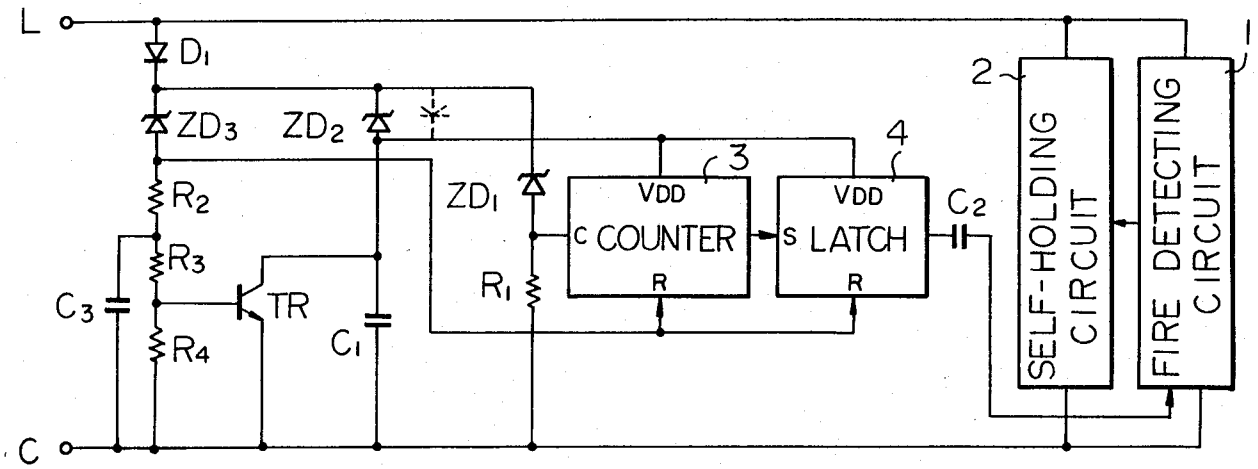
FIRE DETECTING CIRCUIT
SELF-HOLDING CIRCUIT
1
2
C2
4
VDD
S LATCH
R
3
VDD
C COUNTER
R
ZD1
R1
ZD2
C1
TR
D1
ZD3
R2
R3
R4
C3
L
C

SELECTIVELY TESTABLE FIRE DETECTOR

TECHNICAL FIELD OF INVENTION

This invention relates to a fire detector, the operability of which can be selectively tested from a remote location.

In conventional fire detecting systems, fire detectors are distributed in a plurality of sections, a plurality of detectors in each section are connected to an alarm line for that section, and, the respective alarm lines are connected to a receiving unit. Thus, it is not possible to test a selected specific one of the detectors by applying a test signal thereto from the receiving unit. In conventional fire detecting systems, therefore, an inspector must go to each location where a detector is installed in order to test the operability of the detector at that location.

The purpose of this invention is to remove this inconvenience and to provide an improved fire detector which can be tested remotely at the receiving unit of the fire detecting system.

The fire detector of the present invention includes a fire-detecting unit which is supplied with a first voltage and which detects smoke and/or temperature, and, a self-holding circuit which is actuated by an output signal of the fire detecting circuit, and further includes a counter for pulses superimposed on the said first voltage and which outputs a signal when the counted number reaches a predetermined number assigned thereto. A latch circuit latches the output signal of the counter and actuates the fire detecting circuit, and, a reset signal generating circuit resets said counter and the latch circuit when activated by a second voltage which is higher than said first voltage and the superimposed pulses.

By "pulses which are superimposed on the first voltage" is meant pulses which are literally superimposed on the first voltage, to provide an intermittent rise of voltage up to a third voltage as exemplified below, or an intermittent drop in voltage, or, an intermittent interruption of voltage.

The invention is now described in detail with reference to the attached drawing.

BRIEF DESCRIPTION OF THE DRAWING

The attached sole drawing represents the circuit of an embodiment of this invention.

DETAILED DESCRIPTION OF EMBODIMENTS OF THE INVENTION

A fire detecting circuit 1 and a self-holding circuit 2 are connected in parallel to an alarm line L and a common line C, between which a predetermined first voltage is applied from a source not shown. When the fire detecting circuit detects a fire, it actuages the self-holding circuit and informs a monitoring apparatus (not shown) of occurence of a fire.

Between the alarm line L and the common line C, a series of a diode $D_1$, a Zenner diode $ZD_1$ and a resistor $R_1$ is inserted. A counter 3 is connected to the connection of the resistor $R_1$ and the Zenner diode $ZD_1$ via the input terminal C thereof. The Zenner diode $ZD_1$ conducts to operate the fire detecting circuit 1 and the self-holding circuit 2 when a third voltage is applied to the Zenner diode in the form of a pulse signal applied between the alarm line L and the common line C. The third voltage is higher than the first voltage and lower than a second voltage. The second voltage is applied between the lines L and C to reset the counter 3 and a latch circuit 4 as mentioned below. Therefore, when pulses of the third voltage are applied, the pulses are input to the input terminal of the counter.

A series of another Zenner diode $ZD_2$ and a condensor $C_1$ is connected to the above-mentioned diode $D_1$. The condensor $C_1$ is charged by the above-mentioned third voltage via the Zenner diode $ZD_2$, and the voltage charged in the condensor $C_1$ is supplied as operation voltage to a latch circuit 4 connected to the counter 3. The Zenner diode $ZD_2$ does not conduct by the first voltage and therefore it supplies the counter 3 and the latch circuit 4 with necessary voltage only when the detector is tested.

Every time a pulse of the third voltage is applied to the alarm line L, an integer 1 is added to the count of the counter 3. The counter 3 is set so that it transmits a signal when the count reaches a predetermined number assigned thereto. The signal is latched by the latch circuit 4. Even if the count increases further, the latch circuit remains latched. When the latch circuit 4 latches output of the counter 3, the latch circuit outputs a voltage, and applies the change in the output voltage at the time of latching to the fire detecting circuit 1 as the test signal via a condenser $C_2$ inserted between the latch circuit 4 and the fire detecting circuit 1. Then, if the fire detecting circuit is normal, it actuates the self-holding circuit 2 and informs the monitoring apparatus. If the fire detecting circuit is out of order, the self-holding circuit is not actuated. Thus the operability of the fire detector can be judged by the monitoring apparatus. The predetermined number assigned to the counter 3 is different from fire detector to fire detector, it is possible to determine which fire detector is out of order. That is to say, this fire detector is selectively actuatable. After the test, momentary breaking of the input voltage releases the self-holding of the self-holding circuit 2. However, the counter 3 and the latch circuit 4 continue to operate by the voltage stored in the condenser $C_1$.

The above-mentioned counter 3 may, for instance, count pulses of differential of the rise or trailing-down of the pulses superposed on the first voltage which are input through a condenser not shown, instead of pulses per se. In this case, the Zenner diode $ZD_1$ is not necessary. Or else, it is all right if the polarity of the pulses to be superposed on the first voltage is reversed to the polarity of the first voltage. In this case, a diode can be used instead of the Zenner diode $ZD_2$, and this is advantageous since a lower second voltage can be employed.

The diode $D_1$ is connected to the reset terminal of the counter 3 and the reset terminal of the latch circuit 4 via another Zenner diode $ZD_3$, which does not conduct by the above-mentioned third voltage but does by a second voltage which is higher than the third voltage.

To the Zenner diode $ZD_3$ a resistor $R_2$ and a condenser $C_3$ are connected in series, and the other end of the condenser $C_3$ is connected to the common line C. To the two terminals of the condenser $C_3$ a series of resistors $R_3$ and $R_4$ is connected in parallel, and the connection of the resistors $R_3$ and $R_4$ is connected to the base of a transistor TR. The emitter of this transistor TR is connected to the common line C and the collector thereof is connected to the above-mentioned condenser $C_1$. When the second voltage is applied, the transistor TR is turned on and thus it discharges the charge of the condenser $C_1$. Thus, after application of the second voltage, the fire detector immediately returns to the normal operation condition. Incidentally, turning-on of the transistor TR is a little delayed by the effect of the condenser $C_3$.

The fire detector constructed as explained above can be designated by the number of pulses of the third voltage and thus can be selectively tested by applying a test signal. The counter 3 and the latch circuit 4 were reset by applying the second voltage and thus the fire detector is returned to the normal operation condition.

INDUSTRIAL APPLICABILITY

According to this invention, a plurality of fire detector connected to one common alarming line can be selectively tested one by one from the side of the monitoring apparatus. Maintenance and check-up of a plurality of fire detectors can be conveniently carried out.

I claim:

1. A fire detector including:

a fire detecting circuit supplied with a fire voltage through a pair of lines;

a self-holding circuit connected to said lines in parallel with said fire detecting circuit and connected to said fire detecting circuit for it to be activated by an output signal from said fire detecting circuit;

a counter connected between said lines and operative to count pulses superimposed on said first voltage and to provide an output signal upon reaching a pre-set count of said pulses;

a latch circuit connected to said counter and operated by said output signal thereof, said latch circuit having an output connected to said fire detecting circuit to activate said fire detecting circuit upon activation of said latch circuit; and, a re-set signal generating circuit connected between said lines and responsive to a voltage higher than said first voltage and said superimposed pulses, said re-set circuit having an output connected to said counter and said latch circuit and which is operative to re-set said counter and said latch circuit upon detection of said higher voltage.

2. The fire detector of claim 1, further including a Zenner diode through which said counter is connected between said lines, said Zenner diode being a non-conducting at said first voltage and conductive to said superimposed pulses.

3. The fire detector of claim 1, in which said pulses are differential pulses and are input to said counter through a condensor.

4. The fire detector of claim 1, wherein said re-set signal generating circuit includes a Zenner diode which is non-conducting at said first voltage and said superimposed pulses, and which is conductive at said higher voltage.

5. The fire detector of claim 1, further including a second Zenner diode and a condensor connected in series with each other between said lines, said condensor being charged with the voltage of the pulses through said second Zenner diode when said second Zenner diode conducts by the voltage of said pulses, said condensor being connected to supply the charged voltage to said counter and said latch circuit as the operating voltage thereof.

6. The fire detector of claim 5, further including a switch circuit responsive to said higher voltage and providing a discharge circuit for said condensor.

* * * * *